US008428475B2

(12) United States Patent
Tomita et al.

(10) Patent No.: US 8,428,475 B2
(45) Date of Patent: Apr. 23, 2013

(54) WASTE TONER CONTAINER AND IMAGE FORMING APPARATUS INCORPORATING SAME

(75) Inventors: Daisuke Tomita, Tokyo (JP); Shinichi Kawahara, Tokyo (JP); Takeshi Shintani, Kawasaki (JP); Nobuo Kuwabara, Yokohama (JP); Akio Kosuge, Yokohama (JP)

(73) Assignee: Ricoh Company, Ltd, Tokyo (JP)

( * ) Notice: Subject to any disclaimer, the term of this patent is extended or adjusted under 35 U.S.C. 154(b) by 257 days.

(21) Appl. No.: 12/923,923

(22) Filed: Oct. 14, 2010

(65) Prior Publication Data

US 2011/0091227 A1 Apr. 21, 2011

(30) Foreign Application Priority Data

Oct. 15, 2009 (JP) ..... 2009-238154

(51) Int. Cl.
*G03G 21/12* (2006.01)

(52) U.S. Cl.
USPC ..... 399/35; 399/120; 399/264; 399/360

(58) Field of Classification Search ..... 399/35, 399/120, 360
See application file for complete search history.

(56) References Cited

U.S. PATENT DOCUMENTS

| | | | | |
|---|---|---|---|---|
| 7,623,820 | B2 * | 11/2009 | Nada et al. | 399/358 |
| 2008/0013998 | A1 | 1/2008 | Kumagai et al. | |
| 2008/0226333 | A1 | 9/2008 | Ono et al. | |
| 2009/0097879 | A1 | 4/2009 | Nagashima et al. | |
| 2009/0136259 | A1 * | 5/2009 | Ito | 399/120 |
| 2009/0142115 | A1 | 6/2009 | Muraishi et al. | |
| 2010/0040393 | A1 | 2/2010 | Kawahara et al. | |
| 2010/0080600 | A1 * | 4/2010 | Okamoto et al. | 399/71 |

FOREIGN PATENT DOCUMENTS

| | | | |
|---|---|---|---|
| JP | 11-305623 | | 11/1999 |
| JP | 2010204645 | A * | 9/2010 |

* cited by examiner

*Primary Examiner* — David Gray
*Assistant Examiner* — Francis Gray
(74) *Attorney, Agent, or Firm* — Harness, Dickey & Pierce, P.L.C.

(57) ABSTRACT

A waste toner container that collects waste toner that is not used to form an image in an image forming unit of an image forming apparatus, and includes a waste toner collection opening to receive the waste toner output from the image forming unit, a toner amount detector to detect toner amount in the waste toner container, and a waste toner conveyance member disposed inside the waste toner container to convey the waste toner in the waste toner container. The waste toner conveyance member defines a waste toner conveyance direction exchange point, which is a boundary between two different toner conveyance direction regions in which the waste toner is conveyed in opposite directions, and the waste toner conveyance direction exchange point is disposed closer to the toner amount detector than is the waste toner collection opening.

7 Claims, 6 Drawing Sheets

WASTE TONER CONTAINER AND IMAGE FORMING APPARATUS INCORPORATING SAME

This patent specification is based on Japanese Patent Application No. 2009-238154 filed on Oct. 15, 2009 in the Japan Patent Office, the entire contents of which are incorporated by reference herein.

BACKGROUND OF THE INVENTION

1. Field of the Invention

The present invention relates to a waste toner container and an image forming apparatus, and more particularly to a waste toner container capable of stable and efficient toner concentration control and an image forming apparatus that incorporates the waste toner container.

2. Description of the Related Art

Background image forming apparatuses, such as printers, facsimiles, copiers, and multifunction apparatuses that print, facsimile copy, and so on, generally use an electrophotographic process for image forming. In the electrophotographic process, toner is used to form an image.

In the course of image formation, the transfer rate of the toner from source to image is not 100%, and therefore waste toner that is not used to form the image is generated. Typically, the waste toner is collected in a waste toner container provided in the image forming apparatus, after which the waste toner is then discarded.

In the waste toner container, a sensor such as a photointerrupter or the like is provided to detect the amount of toner in the waste toner container. Further, a container having a large capacity is usually employed for collecting the waste toner to prevent the waste toner from leaking out of the waste toner container. For achieving downsizing of the image forming apparatus using electrophotographic process, it is desirable to use more of the space inside the waste toner container to hold waste toner (hereinafter "utilization rate") so as to be able to reduce the overall size of the waste toner container.

As for a procedure to increase the utilization rate of the waste toner in the waste toner container, a tall waste toner container having sufficient height is efficient insofar as the waste toner is accumulated therein in a vertical direction. However, due internal space constraints of a space of the image forming apparatus, it may be necessary to prepare a waste toner container having a flat shape.

Accordingly, various other attempts have been made to increase the utilization rate. For example, in an example image forming apparatus according to JP-H11-305623-A, the waste toner fed into a waste toner container through a toner entrance in the container is conveyed internally by a toner conveyance screw. When the waste toner container is filled with the waste toner, a toner amount detector detects a full-tank condition, i.e., that the waste toner container is filled with the waste container. Further, a shielding body is provided between a side of the toner entrance and a side of the toner amount detection part to avoid erroneous detection at the toner amount detection part even when the waste toner container is detached or inclined. JP-H11-305623-A further describes a mechanism that includes a conveyance direction switching point so as to change the waste toner conveyance direction by the toner conveyance screws in the waste toner container.

However, provision of the shielding body is provided in the container complicates the configuration of the waste toner container. In addition, the conveyance direction switching point is located directly under the toner entrance. Accordingly, the waste toner accumulates symmetrically thereat. As a result, the waste toner is detected when the waste toner is piled up to a height at which the toner amount detector is disposed, but leaving the space inside the container above the toner amount detector unused.

SUMMARY OF THE INVENTION

This patent specification describes a waste toner container that collects waste toner that is not used to form an image in an image forming unit of an image forming apparatus and includes a waste toner collection opening, a toner amount detector, and a waste toner conveyance member. The waste toner collection opening is configured to receive the waste toner output from the image forming unit. The toner amount detector is configured to detect toner amount in the waste toner container. The waste toner conveyance member is disposed inside the waste toner container to convey the waste toner in the waste toner container and defines a waste toner conveyance direction exchange point, which is a boundary between two different toner conveyance direction regions in which the waste toner is conveyed in opposite directions disposed closer to the toner amount detector than the waste toner collection opening.

The waste toner conveyance member may convey the waste toner away from the waste toner conveyance direction exchange point and toward ends of the waste toner container.

The waste toner collection opening may be disposed closer to an end of the waste toner container than to a center of the waste toner container, and may further be disposed on the same side of the waste toner container as the toner amount detector.

The waste toner conveyance member may include a shaft and a screw-shaped spiral member attached to the shaft.

This patent specification further describes an image forming apparatus that includes a main body and the above-described waste toner container. The toner amount detector is disposed at a distal side of the main body of the image forming apparatus with respect to the waste toner collection opening in a direction in which the waste toner container is withdrawn from the image forming apparatus.

The above-described image forming apparatus may further include a waste toner conveyance channel that conveys the waste toner from the image forming unit, provided from the distal side to a proximal side of the image forming apparatus in the direction in which the waste toner container is withdrawn from the image forming apparatus.

The waste toner conveyance channel includes a shaft and a screw-shaped spiral member attached to the shaft.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
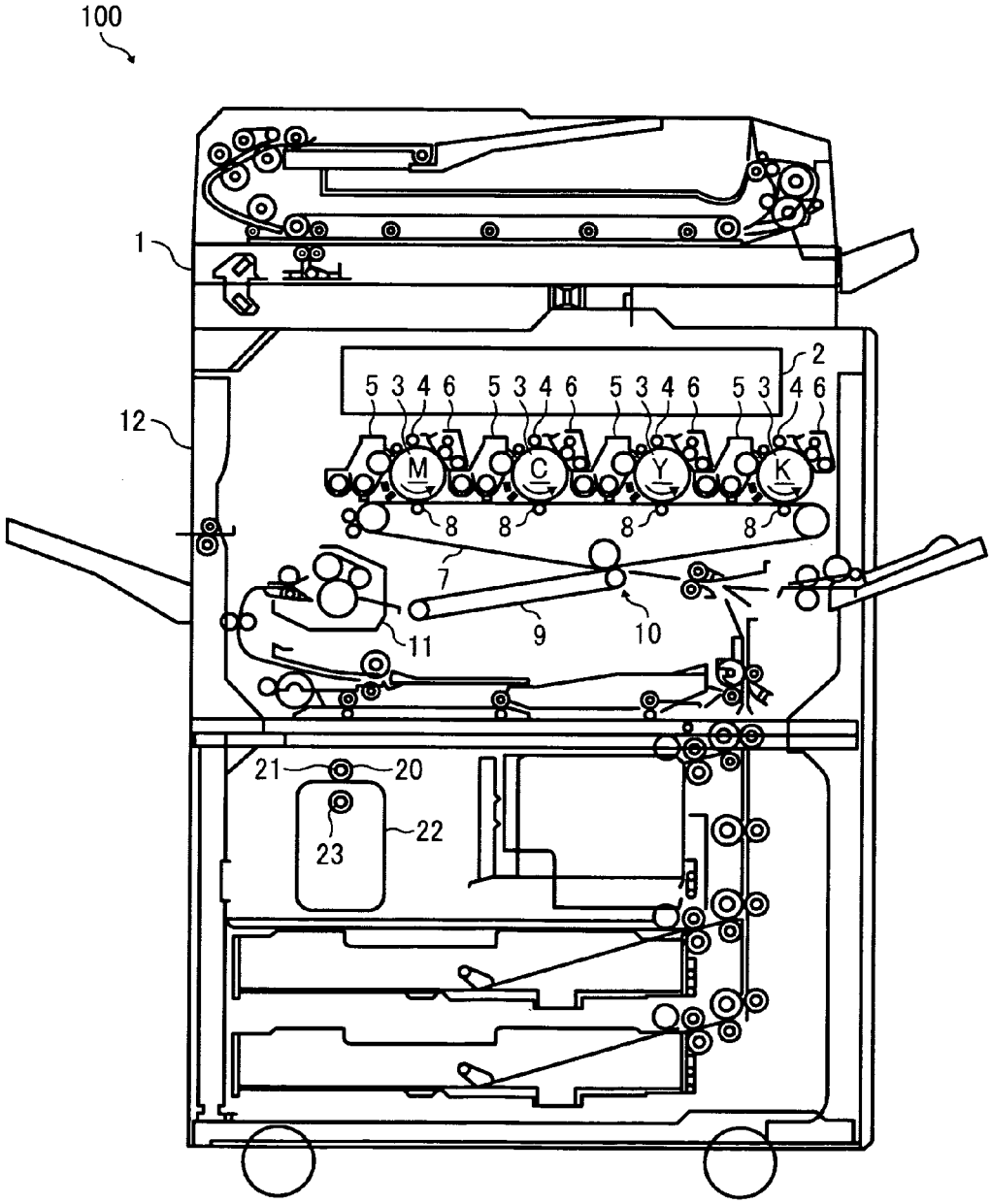
FIG. 1 is a schematic diagram of an example image forming apparatus according to embodiments of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, and in particular to FIG. 1, an image forming apparatus 100 according to an exemplary embodiment of the present invention is described.

FIG. 1 is a schematic diagram of an illustrative example of the image forming apparatus 100 according to the present invention. In the image forming apparatus 100 of FIG. 1, an image is read by a scanner 1, and is broken down into separate color data of black (K), cyan (C), magenta (M), and yellow (Y). The data is then processed and written onto a photoreceptor 3 for each color charged uniformly by a charging roller 4 to form an electrostatic latent image.

The process carried out by an image forming station for black (K) is now described.

The electrostatic latent image formed on the photoreceptor 3 is developed with black (K) toner by a developing unit 5 to form a black (K) toner image. The developed black (K) toner image is transferred onto an intermediate transfer belt 7 at a position at which the intermediate transfer belt 7 touches the photoreceptor 3 to form a nip between the photoreceptor 3 and a primary roller 8. Similarly to black (K), in other image forming stations for cyan (C), magenta (M), and yellow (Y), toner image of each color is formed on the photoreceptor 3. A transfer paper is fed from a resist roller at a timing to match arrival of the toner images transferred to the intermediate transfer belt 7 at a secondary transfer position. The toner images are then transferred collectively onto the transfer paper by a secondary roller 10. Then, the transfer paper is conveyed to a fixing unit 11 by a conveyance belt 9 so that the image is fixed on the transfer paper, after which the transfer paper is output as an image copy.

After transfer process to the intermediate transfer belt 7, residual toner remaining on the photoreceptor 3 is removed by a cleaning device 6. Any electrical charge remaining on the photoreceptor 3 is negotiating by a neutralization lamp, not shown. After that, the photoreceptor 3 is charged uniformly by a charging roller 4 again and the operations described above are repeated.

As for the intermediate transfer belt 7, after the image is transferred to the transfer paper, residual toner remaining on the intermediate transfer belt 7 is removed by an intermediate transfer belt cleaning device, not shown. After that, toner images are transferred again onto the intermediate transfer belt 7 from the photoreceptor 3, then, the toner images are transferred onto the transfer paper collectively. These image forming operations are repeated.

Thus, the residual toner remaining on the photoreceptor 3 or the intermediate transfer belt 7, which is a waste toner 19, is removed by the cleaning device 6 or the intermediate transfer belt cleaning device, respectively. Then, the waste toner 19 is conveyed to a waste toner container 22 disposed at lower part of the image forming apparatus 100 through a waste toner conveyance channel 20, details of which are described below, extending inside the image forming apparatus 100. The waste toner conveyance channel 20 extends from the cleaning device 6 to the waste toner container 22 disposed at a lower part of the image forming apparatus 100. In FIG. 1, the waste toner container 22 is disposed above a paper output tray, however, the waste toner container 22 can be disposed at another space. The image forming apparatus 100 according to the present invention can contain the waste toner 19 in a predetermined amount in the waste toner conveyance channel 20 or in a temporary storage unit. Accordingly, it is possible to continue the printing operation by conveying the waste toner 19 from the cleaning device 6 even when the waste toner container 22 is being removed.

Figure 2:
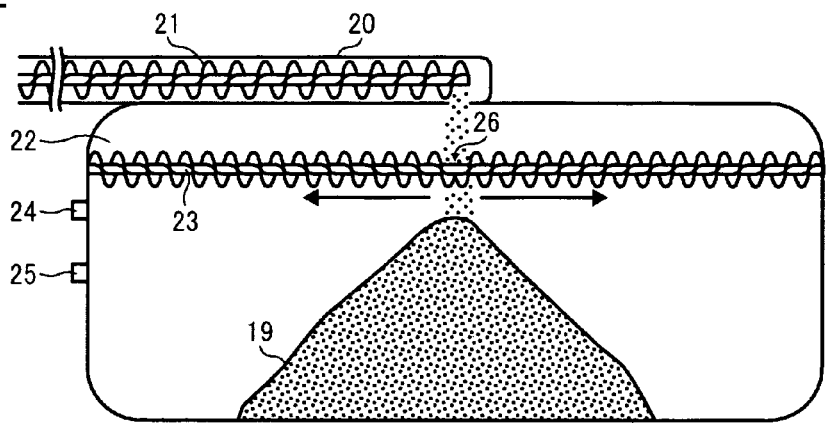
FIG. 2 is a schematic diagram of a known waste toner conveyance channel and waste toner container to represent a process in which the waste toner is dropping from a collection entrance and accumulating to build a mountain shape.
Figure 3:
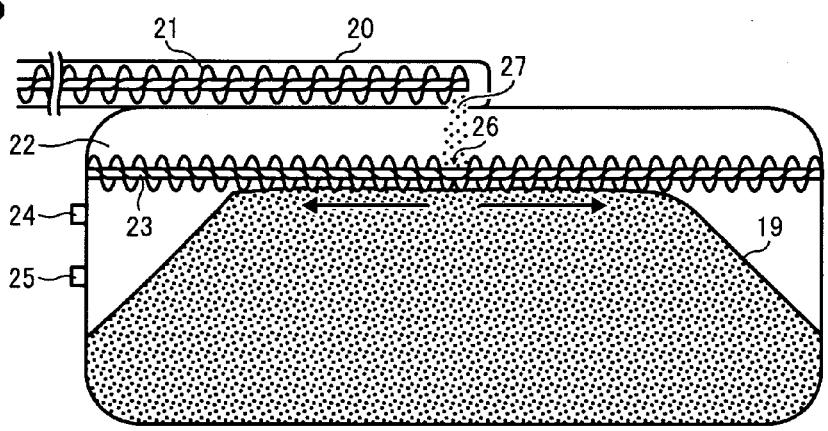
FIG. 3 is a schematic diagram of a known waste toner conveyance channel and waste toner container to represent a process in which the waste toner is piled up to a container conveyance member, the waste toner is conveyed to edges of the container, and a top surface of the waste toner is flattened.

FIG. 2 is an enlarged view representing the waste toner conveyance channel 20 and the waste toner container 22 provided in the image forming apparatus 100 of FIG. 1. While printing, the waste toner 19 is stored in the waste toner container 22 through a leading edge of the waste toner conveyance channel 20 and a waste toner collection opening 27 disposed at center portion of the waste toner container 22. The waste toner conveyance channel 20 includes a channel conveyance member 21 that has a shaft and a screw-shaped spiral member attached to the shaft. The channel conveyance member 21 is driven to rotate by a drive unit, not shown, disposed outside the waste toner conveyance channel 20 to convey the waste toner 19 from left to right in FIG. 2. Further, a container conveyance member 23 that has a shaft and a screw-shaped spiral member attached to the shaft is provided that extends along the entire width of the container at an upper part of the waste toner container 22 inside the waste toner container 22. The container conveyance member 23 is driven to rotate by a drive unit, not shown, disposed outside the waste toner container 22. From the center portion to the end portion of the container conveyance member 23, the screw-shaped spiral member on one half of the container conveyance member 23 has an opposite screw-shaped spiral member on the other half of the container conveyance member 23. Accordingly, when the container conveyance member 23 is driven to rotate, the waste toner 19 at around the center of the waste toner container 22 is conveyed outward along the shaft. The surface of the screw-shaped spiral member is angled at a predetermined angle with respect to the shaft, and therefore the waste toner 19 is distributed by a partial circumferential direction force of the screw-shaped spiral member of the container conveyance member 23.

A full-tank detector 24 that detects when the waste toner container 22 is full is disposed on a side surface of the waste toner container 22. The full-tank detector 24 is formed of an elastic body and senses the pressure of the waste toner 19. Therefore, the full-tank detector 24 is activated when the waste toner 19 is accumulated in front of the full-tank detector 24. Accordingly, the full-tank detector 24 detects not the upper limit position of the waste toner container 22 but the waste toner 19 at a certain level at an upper part of the waste toner container 22. More specifically, the full-tank detector 24 detects a full-tank state before the waste toner container 22 is fully filled with waste toner 19.

Similarly, a nearly full-tank detector 25 is disposed at a position lower than the position of the full-tank detector 24 so as to detect a state in which the waste toner container 22 is almost filled with the waste toner 19.

As shown in FIG. 2, the waste toner 19 is accumulated in the waste toner container 22 to form a mountain shape until a top of the waste toner 19 reaches the container conveyance member 23. After the waste toner 19 reaches the container conveyance member 23, the accumulating waste toner 19 begins to be conveyed symmetrically towards ends of the waste toner container 22 by a rotational drive force of the container conveyance member 23 so that a top surface of the waste toner 19 is flattened.

Figure 4:
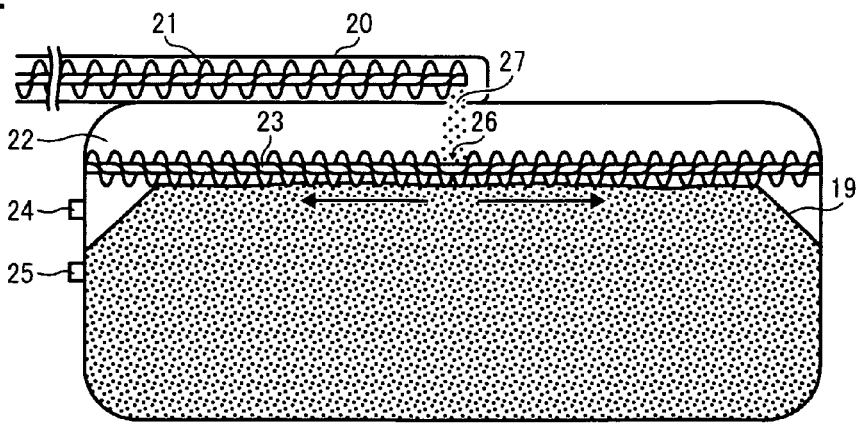
FIG. 4 is a schematic diagram of a known waste toner conveyance channel and waste toner container to represent a process in which the waste toner is piled up to a height of a full-tank detector or a nearly-full-tank detector.

As shown in FIG. 4, when the waste toner 19 arrives at the full-tank detector 24 or the nearly full-tank detector 25, the image forming apparatus 100 displays an alarm on an operation panel disposed at an upper part of the image forming apparatus 100 or sounds an alarm to request replacement of the waste toner container 22, or a halt to the printing operation. As described previously, the container conveyance member 23 extends along the entire width of the waste toner container 22 at an upper part thereof. Further, the container conveyance member 23 flattens the top portion of the waste toner 19 being accumulated and forming maintain shape, and the full-tank detector 24 is disposed at a position slightly lower than the container conveyance member 23. Accordingly, it is possible to detect the waste toner amount accurately and determine whether or not the waste toner container 22 is filled with the waste toner 19.

Since there is still enough space at the upper part of the waste toner container 22 as shown in FIG. 4, it is possible to prevent the waste toner from leaking out of the waste toner container 22, and from clogging the waste toner conveyance channel 20 with the waste toner 19 even when the waste toner container 22 is detached for replacement and the waste toner 19 is accumulated additionally. Consequently, it is possible to prevent the waste toner 19 from dispersing and destroying the channel conveyance member 21. However, since the space at the upper of the waste toner container 22 is not used to store the waste toner 19, the utilization rate of the waste toner 19 is decreased by a corresponding amount.

As shown in FIGS. 1 through 4, in the image forming apparatus 100, the waste toner collection opening 27 is generally disposed at around the center portion of the waste toner container 22. The waste toner 19 conveyed from a main body 12 of the image forming apparatus 100 is collected in the waste toner container 22 by dropping through the waste toner collection opening 27. A conveyance direction switch point 26 is provided on the container conveyance member 23 directly under the waste toner collection opening 27 so that the waste toner 19 is conveyed towards the both ends of the waste toner container 22 from the center portion. More specifically, the waste toner conveyance direction exchange point forms a boundary between two different toner conveyance regions in which the waste toner is conveyed onward in opposite directions.

Accordingly, the waste toner 19 is accumulated conically. More specifically, the waste toner 19 is accumulated symmetrically about the dropping point in the waste toner container 22 to form a conical shape. As a result, a full tank condition is detected even when the waste toner container 22 still has some space and it is possible to store more waste toner.

Further, in a configuration in which a detection sensor is disposed higher than the container conveyance member 23, a toner conveyance power of the container conveyance member 23 is buried in and blocked by the waste toner 19 before the detection of the full-tank condition. Accordingly, conveyance force is weakened so that the waste toner 19 may not be able to press the detection sensor firmly. Consequently, it becomes difficult to detect the full-tank condition reliably.

In the exemplary embodiments according to the present invention, improved waste toner containers that can increase the utilization rate of the waste toner 19 and detect the full-tank condition more accurately are disclosed.

FIGS. 5 through 12 represent a waste toner container according to an illustrative first exemplary embodiment. In FIGS. 5 through 12, elements with the same reference numerals as that in FIGS. 1 through 4 functions in the same way as described above.

Figure 5:
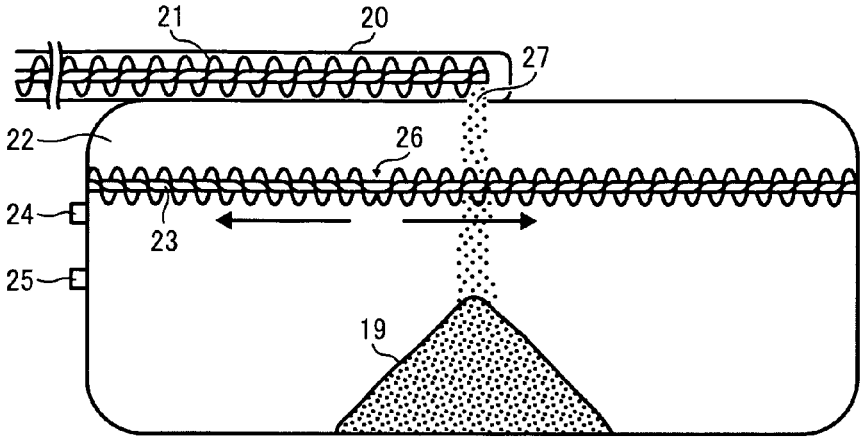
FIG. 5 is a schematic diagram of a waste toner conveyance channel and a waste toner container according to an illustrative first exemplary embodiment to represent a process in which the waste toner is accumulating in the waste toner container and forming a mountain shape.
Figure 6:
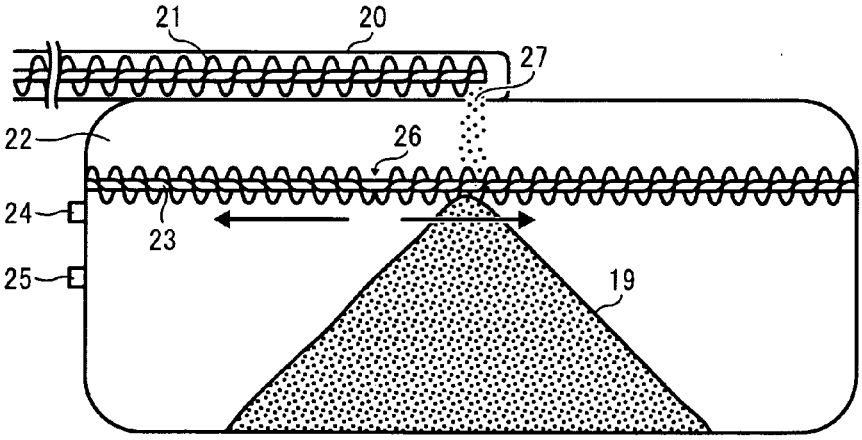
FIG. 6 is a schematic diagram of a waste toner conveyance channel and a waste toner container according to an illustrative first exemplary embodiment to represent a process in which the waste toner is dropping from a waste toner collection opening, is accumulating to form a mountain shape, and a top of the waste toner reaches a container conveyance channel.
Figure 7:
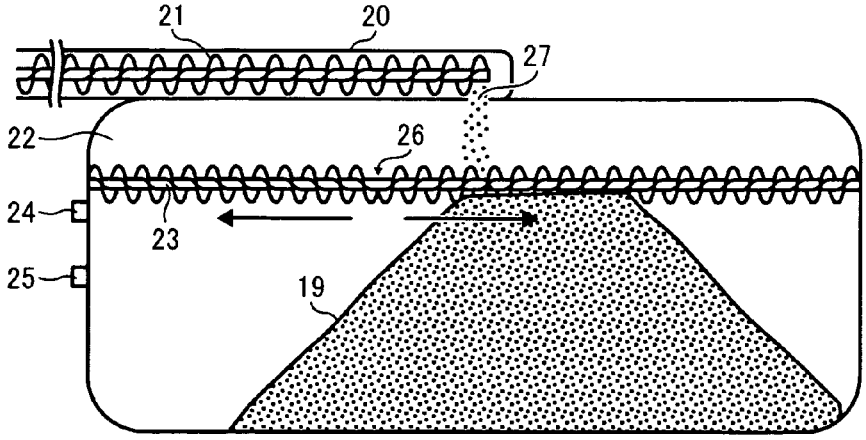
FIG. 7 is a schematic diagram of a waste toner conveyance channel and a waste toner container according to an illustrative first exemplary embodiment to represent a process in which the waste toner dropping from waste toner collection opening is conveyed towards an edge of the waste toner container, and a top surface of the waste toner is flattened.

As shown in FIGS. 5 through 12, the container conveyance member 23 is disposed along the entire width of the waste toner container 22. Detection sensors, which are the full-tank detector 24 and the nearly full-tank detector 25, are disposed at positions close to and under the container conveyance member 23. Further, the conveyance direction switch point 26 is lower than the container conveyance member 23. However, in this exemplary embodiment according to the present invention, the conveyance direction switch point 26 is not provided directly under the waste toner collection opening 27, but is provided instead at a position closer to the full-tank detector 24 and the nearly full-tank detector 25 than is the waste toner collection opening 27. In other words, the conveyance direction switch point 26 is disposed between the waste toner collection opening 27 and the full-tank detector 24 and the nearly full-tank detector 25 in a shaft direction of the container conveyance member 23. Accordingly, as shown in FIGS. 5, 6 and 7, initially the waste toner 19 is piled up to a height of the container conveyance member 23 to form a mountain shape, and is conveyed to a side of the waste toner container 22 opposite the side on which the full-tank detector 24 and the nearly full-tank detector 25 are located.

Figure 8:
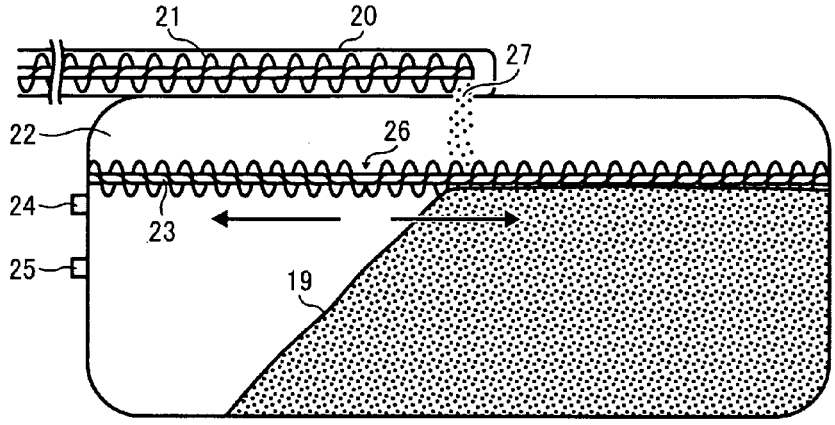
FIG. 8 is a schematic diagram of a waste toner conveyance channel and a waste toner container according to an illustrative first exemplary embodiment to represent a process in which the waste toner reaches the container conveyance member and is pushed further to ends of the waste toner container and the top surface of the waste toner is flattened.
Figure 9:
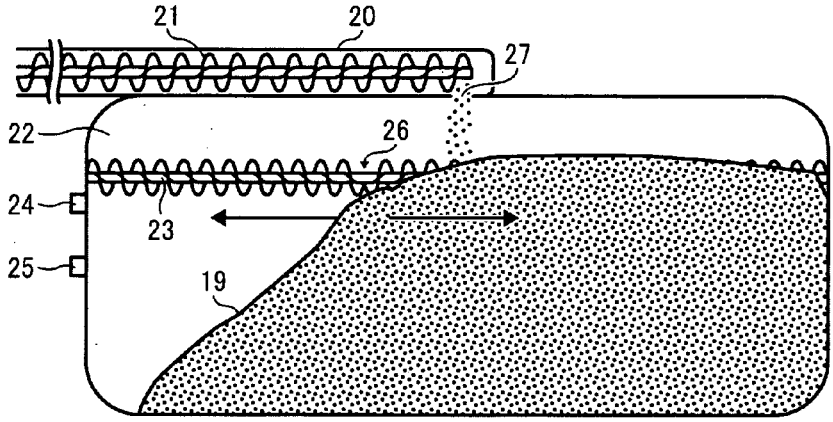
FIG. 9 is a schematic diagram of a waste toner conveyance channel and a waste toner container according to an illustrative first exemplary embodiment to represent a process in which the waste toner is further accumulated and begins to be conveyed towards a detection sensor side.

As shown in FIG. 8, the waste toner 19 is conveyed to the end of the waste toner container 22 and is fed further to the side of the waste toner container 22 opposite the side on which the full-tank detector 24 and the nearly full-tank detector 25 are disposed, so that the waste toner 19 is fully packed in the right side (in FIGS. 5 through 7) of the waste toner container 22. As shown in FIG. 9, a heap of the waste toner 19 is further accumulated. When the heap of the waste toner 19 exceeds a predetermined size, the waste toner 19 starts to be conveyed towards the side of the waste toner container 22 on which the full-tank detector 24 and the nearly full-tank detector 25 are disposed.

Figure 10:
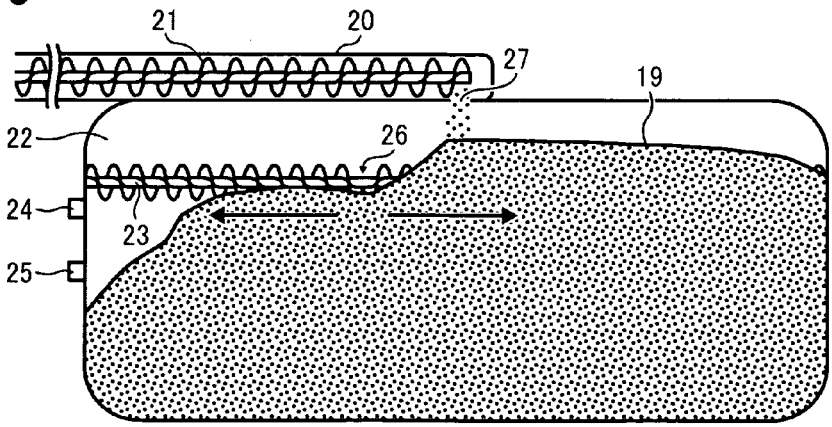
FIG. 10 is a schematic diagram of a waste toner conveyance channel and a waste toner container according to an illustrative first exemplary embodiment to represent a process in which the waste toner is being fed towards the detection sensor side.
Figure 11:
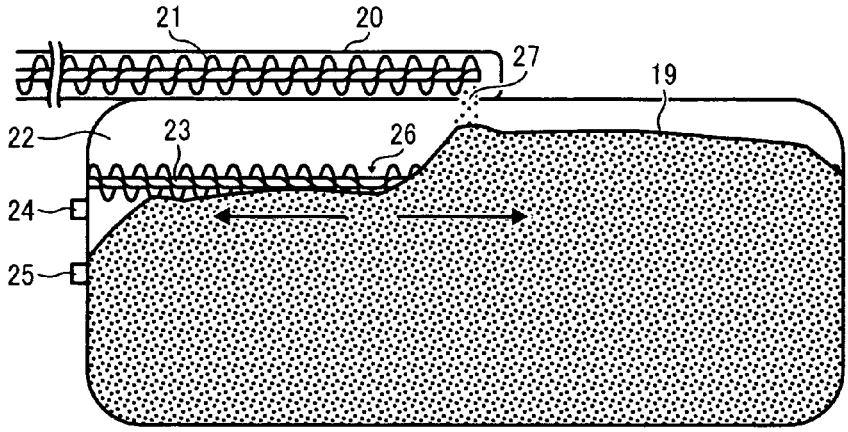
FIG. 11 is a schematic diagram of a waste toner conveyance channel and a waste toner container according to an illustrative first exemplary embodiment to represent a process in which the waste toner reaches the nearly full-tank detection sensor.
Figure 12:
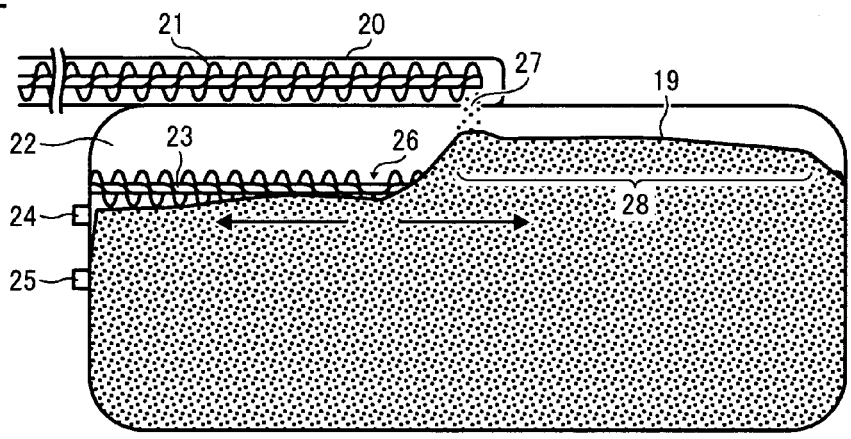
FIG. 12 is a schematic diagram of a waste toner conveyance channel and a waste toner container according to an illustrative first exemplary embodiment to represent a process in which the waste toner reaches the full-tank detection sensor.

As shown in FIG. 10, when the heap of the waste toner 19 reaches a predetermined size, the waste toner 19 starts to be conveyed toward the full-tank detector 24 and the nearly full-tank detector 25. The waste toner 19 is fed to a vicinity of the full-tank detector 24 and the nearly full-tank detector 25. When the waste toner 19 reaches the full-tank detector 24 and the nearly full-tank detector 25, as shown in FIGS. 11 and 12, the full-tank detector 24 and the nearly full-tank detector 25 detect the waste toner 19. Consequently, it is possible to detect full-tank condition or nearly full-tank condition reliably. Thus, since the waste toner 19 is accumulated in the space opposite side to the full-tank detector 24 and the nearly full-tank detector 25 initially, as shown in FIG. 12, the waste toner upper part accumulation layer accumulates at a high area exceeding the height of the container conveyance member 23 at a right side of the conveyance direction switch point 26, so that the utilization rate of the waste toner 19 of the waste toner container 22 is increased.

As noted previously, the waste toner container 22 is detachably provided to the image forming apparatus 100. After the full-tank condition is detected, the waste toner container 22 is replaced with a new empty waste toner container.

The waste toner container 22 is installed in the image forming apparatus 100 by pushing the waste toner container 22 into the image forming apparatus 100 from the left in FIG. 12, and is removed from the main body 12 of the image forming apparatus 100 by drawing the waste toner container 22 out of the image forming apparatus 100 to the right in FIG. 12. The full-tank detector 24 and the nearly full-tank detector 25 are disposed on the waste toner container 22 at the distal side of the main body 12 of the image forming apparatus 100, that is, on the left in FIG. 12. The waste toner conveyance channel 20 extends from the distal side to a proximal side in a withdrawing direction of the waste toner container 22, that is, a direction in which the waste toner container 22 is withdrawn from the image forming apparatus 100. Accordingly, the waste toner 19 is accumulated in the proximal side by a drive rotation of the container conveyance member 23 initially. Then, the waste toner 19 is fed in the distal side, and is detected by the full-tank detector 24 and the nearly full-tank detector 25.

As described above, when the waste toner conveyance channel 20 extends from the distal side to the proximal side in the image forming apparatus 100, the full-tank detector 24 and the nearly full-tank detector 25 are disposed on the container 22 at the distal side of the main body 12 of the image forming apparatus 100. In such a configuration, the waste toner 19 is brought in at the proximal side of the waste toner container 22 by the container conveyance member 23 initially, so that the waste toner 19 is stored efficiently in the waste toner container 22. Further, the detection sensors 24 and 25 disposed at the distal side of the main body 12 detect the stored toner condition. As a result, it is possible to minimize the length of the waste toner conveyance channel 20. Furthermore, the waste toner 19 is conveyed in the proximal side of the waste toner container 22. Then, the waste toner 19 is conveyed to the distal side of the waste toner container 22. Consequently, it is possible to fully use the space of the waste toner container 22.

If the full-tank detector 24 and the nearly full-tank detector 25 must be disposed at the proximal side of the waste toner container 22, the conveyance direction switch point 26 may then be disposed between the full-tank detector 24 and the nearly full-tank detector 25 and the waste toner collection opening 27. In such a configuration, the full-tank detector 24 and the nearly full-tank detector 25 are placed at the proximal side of the main body 12 of the image forming apparatus 100. Accordingly, the waste toner 19 is brought in at the distal side of the waste toner container 22 initially, so that the waste toner 19 is stored efficiently in the waste toner container 22. Then, the stored toner condition is detected by the full-tank detector 24 and the nearly full-tank detector 25 disposed at the proximal side of the main body 12 of the image forming apparatus 100.

Figure 13:
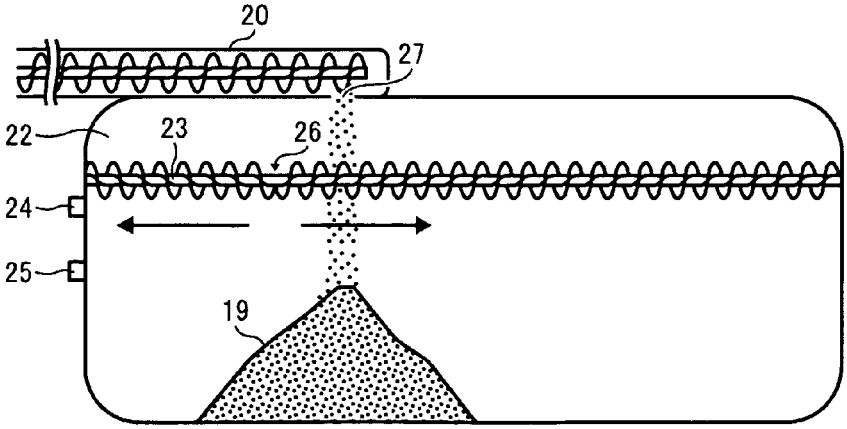
FIG. 13 is a schematic diagram of a waste toner conveyance channel and a waste toner container according to an illustrative second exemplary embodiment to represent a process in which the waste toner is accumulating in the waste toner container and forming a mountain shape.
Figure 14:
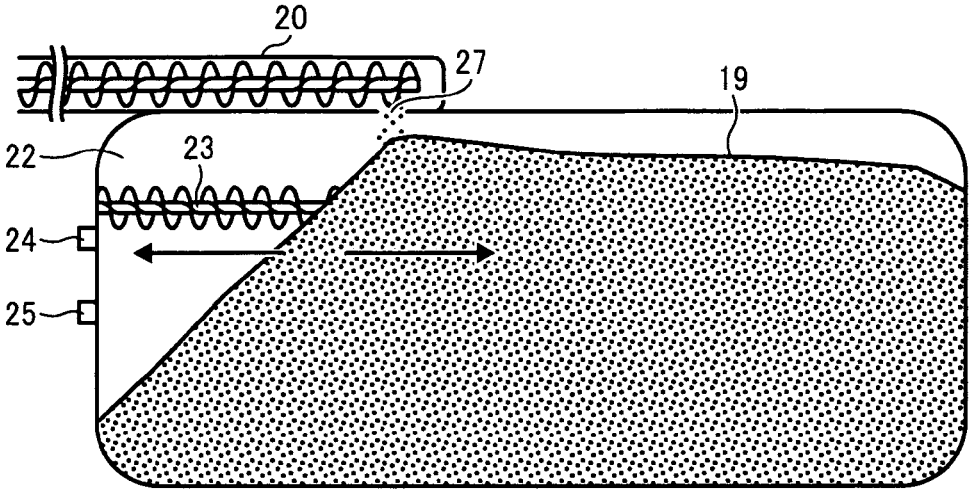
FIG. 14 is a schematic diagram of a waste toner conveyance channel and a waste toner container according to an illustrative second exemplary embodiment to represent a process in which the waste toner is being fed towards the detection sensor side.
Figure 15:
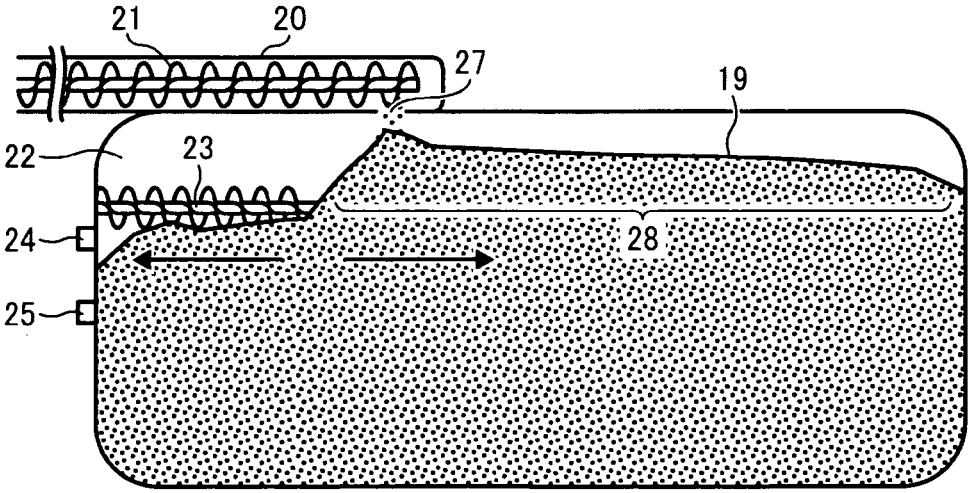
FIG. 15 is a schematic diagram of a waste toner conveyance channel and a waste toner container according to an illustrative second exemplary embodiment to represent a process in which the waste toner reaches the nearly full-tank detection sensor.

FIGS. 13 through 15 represent a waste toner container according to an illustrative second exemplary embodiment. In FIGS. 13 through 15, elements with the same reference numerals as that in the first exemplary embodiment illustrated in FIGS. 5 through 12 functions in the same way as described above.

In the second exemplary embodiment, as shown in FIGS. 13 through 15, the waste toner collection opening 27 is disposed closer to the full-tank detector 24 and the nearly full-tank detector 25 and away from the center of the waste toner container 22. Accordingly, the space on the opposite side of the full-tank detector 24 and the nearly full-tank detector 25 with respect to the waste toner collection opening 27 is increased. Therefore, more waste toner 19 can be conveyed in the direction opposite to the full-tank detector 24 and the nearly full-tank detector 25, resulting in a further increase in the utilization rate of the waste toner 19. Similarly to the case previously described, after the waste toner 19 forms a mountain shape and is piled up to a predetermined height, the waste toner 19 begins to be conveyed toward the full-tank detector 24 and the nearly full-tank detector 25. Consequently, it is possible to detect the full-tank condition more reliably. Further, according to the second exemplary embodiment, it is possible to place the waste toner collection opening 27 at any position so that the length of the waste toner conveyance channel 20 at a side of the main body 12 can be shortened, resulting in an increase in flexibility of the layout for the main body 12 of the image forming apparatus 100, and a reduction of the risk of clogging of the waste toner conveyance channel 20 by the waste toner 19.

As shown in FIG. 15, it is found that a top waste toner accumulation portion 28 in FIG. 15 is larger than that in FIG. 12. Since the position of the waste toner collection opening 27 is disposed closer to the full-tank detector 24 and the nearly full-tank detector 25 apart from the center of the waste toner container 22, the space opposite to the side of the full-tank detector 24 and the nearly full-tank detector 25 with respect to the waste toner collection opening 27 is increased so that a large amount of the waste toner 19 can be stored therein. Consequently, it becomes possible to achieve a further increase in the utilization rate of the waste toner 19.

The above-described exemplary embodiments are illustrative, and numerous additional modifications and variations are possible in light of the above teachings. For example, elements and/or features of different illustrative and exemplary embodiments herein may be combined with each other and/or substituted for each other within the scope of this disclosure. It is therefore to be understood that, the disclosure of this patent specification may be practiced otherwise than as specifically described herein.

Obviously, numerous modifications and variations of the present patent application are possible in light of the above teachings. It is therefore to be understood that, the invention may be practiced otherwise than as specifically described herein.

What is claimed is:

1. A waste toner container that collects waste toner that is not used to form an image in an image forming unit, the waste toner container comprising:

a waste toner collection opening configured to receive the waste toner output from the image forming unit;

a toner amount detector configured to detect toner amount in the waste toner container; and a waste toner conveyance member disposed inside the waste toner container to convey the waste toner in the waste toner container and defining a waste toner conveyance direction exchange point, which is a boundary between two different toner conveyance direction regions in which the waste toner is conveyed in opposite directions disposed closer to the toner amount detector than the waste toner collection opening.

2. The waste toner container according to claim 1, wherein the waste toner conveyance member conveys the waste toner away from the waste toner conveyance direction exchange point and toward ends of the waste toner container.

3. The waste toner container according to claim 1, wherein the waste toner collection opening is disposed closer to an end of the waste toner container than to a center of the waste toner container, and is further disposed on the same side of the waste toner container as the toner amount detector.

4. The waste toner container according to claim 1, wherein the waste toner conveyance member includes a shaft and a screw-shaped spiral member attached to the shaft.

5. An image forming apparatus, comprising:

a main body; and the waste toner container according to claim 1, wherein the toner amount detector is disposed at a distal side of the main body of the image forming apparatus with respect to the waste toner collection opening in a direction in which the waste toner container is withdrawn from the image forming apparatus.

6. The image forming apparatus according to claim 5, further comprising a waste toner conveyance channel that conveys the waste toner from the image forming unit, provided from the distal side to a proximal side of the image forming apparatus in the direction in which the waste toner container is withdrawn from the image forming apparatus.

7. The image forming apparatus according to claim 6, wherein the waste toner conveyance channel includes a shaft and a screw-shaped spiral member attached to the shaft.

* * * * *